US010676807B2

(12) United States Patent
Karhausen et al.

(10) Patent No.: US 10,676,807 B2
(45) Date of Patent: Jun. 9, 2020

(54) METHOD AND DEVICE FOR CHANGING THE TEMPERATURE OF METAL STRIPS IN A FLATNESS-ADAPTIVE MANNER

(71) Applicants: Kai-Friedrich Karhausen, Bonn (DE); Holger Aretz, Mayschoß (DE)

(72) Inventors: Kai-Friedrich Karhausen, Bonn (DE); Holger Aretz, Mayschoß (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

(21) Appl. No.: 15/867,289

(22) Filed: Jan. 10, 2018

(65) Prior Publication Data

US 2018/0135156 A1 May 17, 2018

Related U.S. Application Data

(63) Continuation of application No. PCT/EP2016/067933, filed on Jul. 27, 2016.

(30) Foreign Application Priority Data

Jul. 28, 2015 (DE) ..... 10 2015 112 293

(51) Int. Cl.
*B21B 37/44* (2006.01)
*C21D 11/00* (2006.01)
(Continued)

(52) U.S. Cl.
CPC ..... *C22F 1/04* (2013.01); *B21B 37/44* (2013.01); *C21D 1/34* (2013.01); *C21D 9/46* (2013.01);
(Continued)

(58) Field of Classification Search
CPC ..... B21B 37/44; C21D 9/562; C21D 9/54; C21D 11/00; C21D 11/005
See application file for complete search history.

(56) References Cited

U.S. PATENT DOCUMENTS 5,382,306 A * 1/1995 Plata ..... B05B 7/0861 148/511
5,640,872 A 6/1997 Plata et al.
(Continued)

FOREIGN PATENT DOCUMENTS

AT 73 599 B 11/1992
CN 1119969 A 4/1996
(Continued)

OTHER PUBLICATIONS

Davis, J.R. "Aluminum and Aluminum alloys", ASM International, p. 328-332. (Year: 1993).*

*Primary Examiner* — George Wyszomierski
*Assistant Examiner* — Janell C Morillo
(74) *Attorney, Agent, or Firm* — Reinhart Boerner Van Deuren P.C.

(57) ABSTRACT

The invention relates to a device for changing the temperature of a metal strip including means for changing the temperature of the metal strip by heating or cooling. By using means for conveying the metal strip, the metal strip is moved in the strip direction relative to the means for changing the temperature of the metal strip. The object of providing a device for changing the temperature of metal strips, which allows improved process control and improved flatness of the treated metal strip, is achieved according to the invention by a device in that means for changing the temperature of the metal strip include a plurality of individual temperature-control means which each heat or cool the metal strip only in some regions, and at least the position of a plurality of the temperature-control means can be individually changed translationally and/or rotationally relative to the metal strip.

19 Claims, 3 Drawing Sheets

(51) Int. Cl.

| | |
|---|---|
| ***C22F 1/04*** | (2006.01) |
| ***C21D 1/34*** | (2006.01) |
| ***C21D 9/46*** | (2006.01) |
| *C21D 1/667* | (2006.01) |

(52) U.S. Cl.
CPC ..... *C21D 11/00* (2013.01); *C21D 1/667* (2013.01); *C21D 2221/00* (2013.01)

(56) References Cited

U.S. PATENT DOCUMENTS

| | | | | |
|---|---|---|---|---|
| 2012/0318478 | A1* | 12/2012 | Weinzierl ..... | B21B 37/76<br>165/104.11 |
| 2014/0250963 | A1 | 9/2014 | Nelson et al. | |

FOREIGN PATENT DOCUMENTS

| | | | |
|---|---|---|---|
| CN | 1336853 | A | 2/2002 |
| CN | 1278792 | C | 10/2006 |
| CN | 101356290 | A | 1/2009 |
| CN | 101778679 | A | 7/2010 |
| DE | 3515459 | A1 | 10/1986 |
| DE | 10 2011 009 195 | A1 | 12/2011 |
| EP | 0 695 590 | A1 | 2/1996 |
| EP | 1 634 657 | A1 | 3/2006 |
| GB | 2174632 | A | 11/1986 |
| WO | WO 2007/075138 | A1 | 7/2007 |
| WO | WO 2009/024644 | A1 | 2/2009 |

* cited by examiner

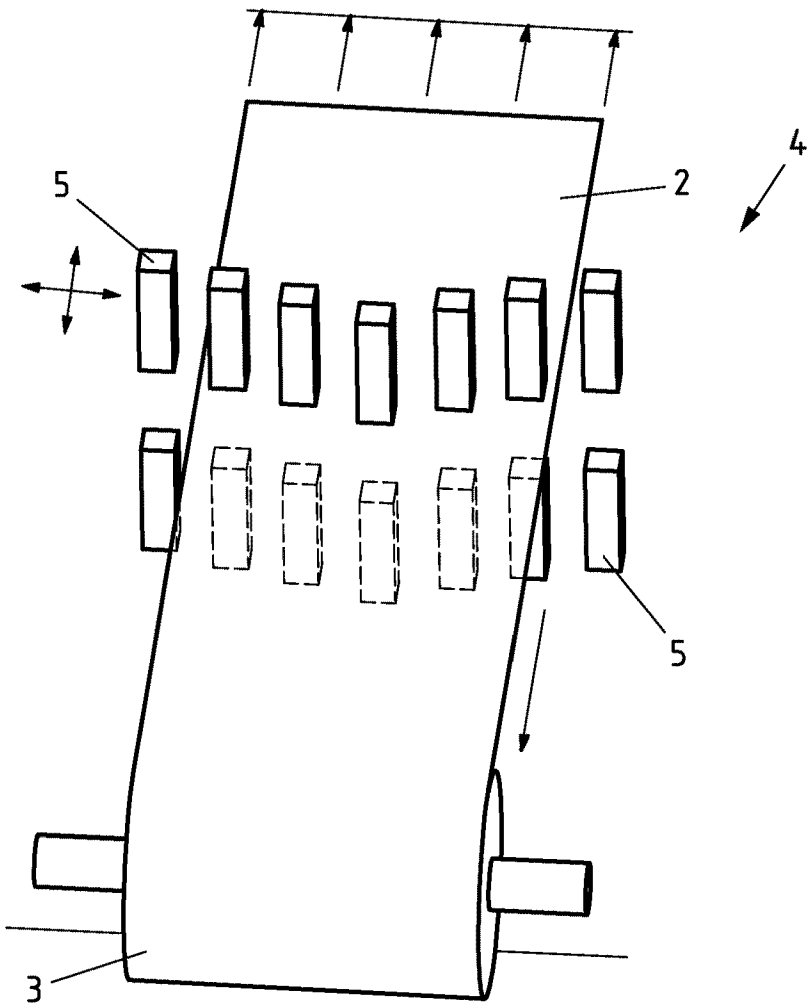
Fig.2
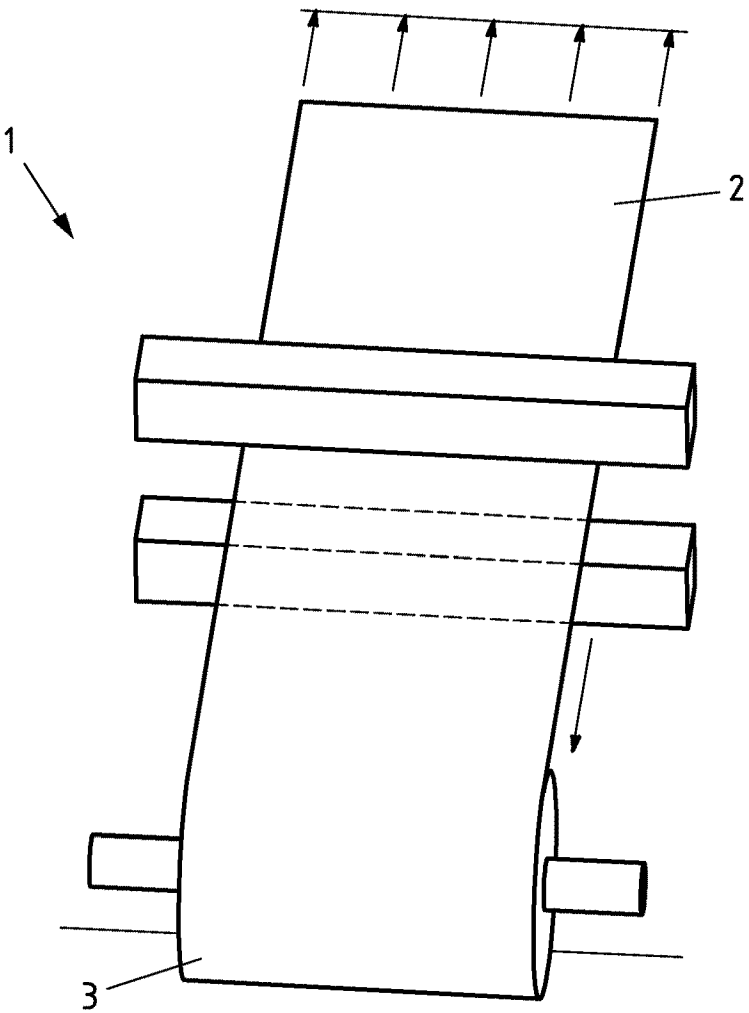
Fig.1 State of the art 4
2
5
8
α
5
7
6

2
6a
5
5
5
5
5
5
6b

METHOD AND DEVICE FOR CHANGING THE TEMPERATURE OF METAL STRIPS IN A FLATNESS-ADAPTIVE MANNER

CROSS-REFERENCE TO RELATED PATENT APPLICATIONS

This patent application is a continuation of PCT/EP2016/067933, filed Jul. 27, 2016, which claims priority to German Application No. 10 2015 112 293.6, filed Jul. 28, 2015, the entire teachings and disclosure of which are incorporated herein by reference thereto.

FIELD OF INVENTION

The invention relates to a device for changing the temperature of a metal strip, in particular of a metal strip made of aluminium or an aluminium alloy, comprising means for changing the temperature of the metal strip by heating or cooling, in which, by using means for conveying the metal strip, the metal strip is moved in the strip direction relative to the means for changing the temperature of the metal strip. Furthermore, the invention relates to a use of a device according to the invention for continuously machining metal strips, in particular aluminium or aluminium alloy strips. The invention further relates to a method for continuously changing the temperature of a metal strip, preferably of an aluminium or aluminium alloy strip of a device according to the invention.

BACKGROUND OF INVENTION

Metal strips, for example steel strips but also aluminium or aluminium alloy strips, are conventionally subjected to heat treatments in order to provide specific properties of the metal strip. For this purpose, steel strips, but also aluminium alloy strips, are heated and/or very quickly cooled using temperature-control means. However, the temperature ranges in which steel strips and aluminium alloy strips are heated in heat treatments differ considerably. Heating steel strips to achieve recrystallisation lies in the range of 950° C. and above, whereas aluminium alloy strips already recrystallise at temperatures of around 300° C. In the case of some aluminium alloys, however, for example for subsequent precipitation hardening, alloy elements must be put into solution, in which temperatures of 580° C. must be reached. In order to subsequently be able to keep the alloy elements in an oversaturated state in the matrix, it is necessary to quickly quench from this temperature.

Often, high heating and cooling rates are also required for other metallurgical reasons (e.g. for grain refinement). Due to the need for high heating or cooling speeds, heat treatments of this type cannot be carried out on the wound-up coil, but rather must take place on the continuous strip in what are known as continuous furnaces and cooling lines. The rapid heating or cooling causes thermal stresses, which, in particular in the case of thin strips, lead to distortions, which can both prevent a steady strip run during the ongoing process and cause flatness defects in the finished product.

The objective of a heat treatment on the continuous strip is to change the temperature level homogeneously over the entire width of the strip in a short space of time in order to change the properties uniformly over the entire width of the strip in a desired manner. In the case of a uniform change in temperature taking place linearly and transversely to the strip, however, thermally induced transverse stresses always occur, which cause distortions. The reason for this is that strip fibres close to the centre are constricted under thermal loading by the neighbouring fibres in the transverse flow, whereas the strip edges can expand and contract freely.

The prior art discloses, both for cooling metal strips made of steel and for cooling aluminium strips, devices for changing the temperature of the metal strip, comprising means for cooling the metal strip and means for conveying the metal strip relative to the means for changing temperature, by which a metal strip can be for example continuously cooled. Such a method, in which both temperature and flatness are measured on a thick steel strip, is disclosed in the European Patent Application EP 1 634 657 1. The International Patent Application WO 2009/024644 A1 also relates to a method and to a device for checking the flatness of steel strips, which comprises individually activatable temperature-control means arranged at fixed distances for bringing about specific cooling of the steel strip. A fixed arrangement of the cooling means for cooling a metal strip made of an aluminium alloy is disclosed by the US Patent Application US 2014/0250963 A1. Despite the cooling power of the individual temperature-control means being controlled according to the flatness of the metal strip after cooling or according to temperature measurements of the metal strip after cooling, the existing concepts for changing the temperature of a metal strip, that is to say the concepts for heating metal strips for heat treatment and the concepts for cooling metal strips after a heat treatment are in need of improvement, since there are still problems relating to flatness defects in production.

The invention therefore addresses the object of providing a device for changing the temperature of metal strips, which, in particular in the case of changes in temperature of aluminium strips, allows improved process control and greater precision in terms of the flatness of the treated metal strip. Furthermore, a preferred use of the device according to the invention and a method for changing the temperature of a metal strip using the device according to the invention are to be proposed.

BRIEF SUMMARY OF THE INVENTION

The described object is achieved according to a first teaching of the present invention by a device in that means for changing the temperature of the metal strip comprise a plurality of individual temperature-control means which each heat or cool the metal strip only in some regions, and in that the position of at least a plurality of the temperature-control means can be changed translationally and/or rotationally relative to the metal strip.

It has become apparent that, in particular in the case of a change in temperature of aluminium strips or strips made of an aluminium alloy, optimum heating or cooling of the metal strips is made possible by changing the position of individual temperature-control means in a flatness-adaptive manner so that the stresses produced in the metal strip due to the change in temperature during heating or cooling can be minimised. As a result, a particularly precise temperature profile can be introduced into the metal strip whilst conveying the metal strip relative to the means for changing the temperature of the metal strip. As already remarked previously, the individual temperature-control means can raise or lower the temperature of the metal strip only in some regions. By translationally and/or rotationally changing the position of the temperature-control means, the regions in which the temperature is changed by the temperature-control means can be moved very precisely relative to one another on the metal strip. As a result, the regions of the metal strip to be cooled and heated can be adjusted precisely to prevent stresses in the metal strip. In contrast with a rigid arrangement of temperature-control means, such as is known from the documents from the prior art, a considerably finer temperature change profile can be produced in the metal strip in this manner. The result is considerably improved flatness of the metal strip both when heating the metal strips and when cooling a heat-treated metal strip. By means of the previously explained measures, in particular in the case of aluminium alloy strips, it is possible to take into account the fact that, in the case of large changes in temperature, in particular when heating above 250° C., strong softening processes occur in already strongly heated metal strip regions, which processes lead to plastic deformations of the aluminium alloy strip. During cooling, these plastic deformations lead to flatness defects, which can be effectively eliminated by the device according to the invention.

According to a first embodiment of the device according to the invention, the position of at least one temperature-control means can be individually changed translationally in the longitudinal direction of the metal strip, in the transverse direction of the metal strip and/or at a distance from the metal strip. In other words, at least one temperature-control means, preferably a plurality of temperature-control means, can undergo a translational position change in order to improve the flatness of the metal strip when heating the metal strip or when cooling the metal strip.

Preferably, the temperature-control means are arranged on one or both sides of the metal strip. A one-sided arrangement requires less effort for installation and regulation of the positions of the individual temperature-control means. An arrangement on both sides allows quick changes in temperature, even in the case of larger metal strip thicknesses, and the production of large temperature gradients.

According to another embodiment, at least one temperature-control means, preferably also a plurality of temperature-control means, is/are arranged individually rotatable about an axis of rotation so that, by means of rotation, the temperature-control means is variably positionable in its angle to the metal strip surface. Changing the angle of the temperature-control means to the metal strip surface makes it possible to not only move the position of the effective region of an individual temperature-control means, but also to change the heat or cold-transmission profile on the metal strip of each individual temperature-control means. Preferably, for this purpose, the temperature-control means are rotated about an axis of rotation which extends in parallel with the transverse direction of the strip surface. This rotation results in a position of the effective region of an individual temperature-control means which changes in the strip direction.

A particularly flexible adjustment of a temperature gradient on the metal strip surface can be achieved according to another embodiment of the device in that the position of at least one temperature-control means or a plurality of temperature-control means can be changed with respect to all the translational and rotational degrees of freedom.

Preferably, according to another embodiment, the cooling or heating power of the individual temperature-control means can be adjusted separately from one another. The independent adjustment of the heating or cooling power of an individual temperature-control means can be utilised to achieve very good flatness of the metal strip as an additional degree of freedom for varying the position of the temperature-control means both when heating the metal strip during the heat treatment and when cooling the metal strip after the heat treatment.

In another embodiment of the device according to the invention, for this purpose, means for measuring the flatness of the metal strip and at least one control unit are provided, which control or regulate the geometric position, the geometric orientation and/or the cooling or heating power of at least one temperature-control means, preferably of a plurality of temperature-control means, according to the determined flatness of the metal strip. During the control, the position, orientation and/or heating or cooling power of the individual temperature-control means is preferably fixed according to a preset profile. Regulation further allows feedback of the measured flatness values to change the position, orientation and/or the heating or cooling power of the individual, or of a plurality of, temperature-control means again.

According to another embodiment, temperature-control means which transmit heat to the metal strip or extract heat from the metal strip by radiation, conduction, convection and/or induction can be used as temperature-control means for this purpose. Heat radiators are for example typical radiative temperature-control means. The electromagnetic heat radiation thereof is absorbed by the metal strip. In the case of conductive temperature-control means, media are applied to the metal strip which directly heat or cool the metal strip. Convective temperature-control means can for example heat metal strips by means of hot-air blowers, that is to say using hot gases. Metal strips can also be heated inductively, in that the temperature-control means generate eddy currents in the metal strip.

Lastly, according to another embodiment of the device according to the invention, the temperature-control means have an arcuate position in relation to the transverse direction of the metal strip, the temperature-control means arranged in the region of the centre of the metal strip being arranged so as to lead or trail in the direction of travel of the metal strip. By the temperature-control means which are arranged so as to lead or trail in the direction of travel of the metal strip, the metal strip is for example heated or cooled in the central region earlier or later than in the edge region. In the width direction of the strip, the same amount of energy can be supplied to every fibre so that a uniform temperature level is achieved. This energy supply is introduced over the width at staggered intervals so that the build-up of transverse stresses is prevented, and thus a steady strip run is ensured. Wavinesses of the metal strip, i.e. flatness defects, are therefore considerably reduced.

According to another teaching of the present invention, the object described above is achieved by using a device according to the invention for continuously machining metal strips, in particular aluminium or aluminium alloy strips. The continuous machining of for example aluminium or aluminium alloy strips takes place in so-called annealing lines, rolling trains, but also painting, laminating or other coating plants which continuously machine the surface of the metal strip or the metal strip itself. In all of these devices, the use of the device according to the invention for changing temperature leads to improved flatness results, since it is made possible to very flexibly and precisely prevent stresses in the metal strip, in particular in the aluminium alloy strip, in a process-specific manner.

According to a third teaching of the present invention, the object described above is achieved by a method for continuously changing the temperature of a metal strip, preferably of an aluminium or aluminium alloy strip, using a device according to the invention, in that the temperature of the metal strip is changed in a heat treatment apparatus, in a coating plant or in a rolling mill for metal strips, preferably aluminium or aluminium alloy strips.

As already remarked previously, the change in temperature of the metal strip using the device according to the invention is carried out in a corresponding method in such a way that it leads to very minor changes in flatness of the metal strip. All the downstream production steps can therefore be carried out with very high precision.

According to another embodiment of the method according to the invention, the position of at least one variably positionable temperature-control means, preferably of a plurality of variably positionable temperature-control means, is changed relative to the metal strip in such a way that the stresses in the metal strip are reduced as a result of the change in temperature of the metal strip. By means of this measure, it is ensured that, in turn, the flatness of the metal strip increases further, and wavinesses are prevented.

If, according to another embodiment of the method, a change in temperature of the metal strip takes place by individual temperature-control means which are arranged in an arcuate shape relative to the transverse direction of the metal strip so as to lead or trail in the direction of travel of the strip, as already remarked, an advantageous temperature profile, in particular a temperature profile which is preferred when heating the metal strip, is introduced into the metal strip, which profile leaves behind particularly minor flatness defects in the metal strip.

Lastly, according to another embodiment, the method according to the invention is further improved in that, by means for measuring flatness, the flatness of the metal strip is detected before and/or after the change in temperature and, according to the measured flatness, using control means, the position of the individual temperature-control means relative to the metal strip is changed. As a result, an adaptation of the temperature profile to ambient conditions, to production speeds of the metal strip and also to metal strip thicknesses or alloys can be adapted to minimise the flatness defects. In addition to a translational and/or rotational change in the position of the temperature-control means, a change in the heating or cooling power of the individual temperature-control means is of course also possible in order to reduce flatness defects.

BRIEF DESCRIPTION OF THE SEVERAL VIEWS OF THE DRAWING

The invention will be described in greater detail below with reference to embodiments in conjunction with the drawing. The drawing shows in FIG. 1 shows a perspective view of a conventional device for changing the temperature of a metal strip, FIG. 2 shows a perspective view of a first embodiment of a device according to the invention.

DETAILED DESCRIPTION OF THE INVENTION

Figure 3:
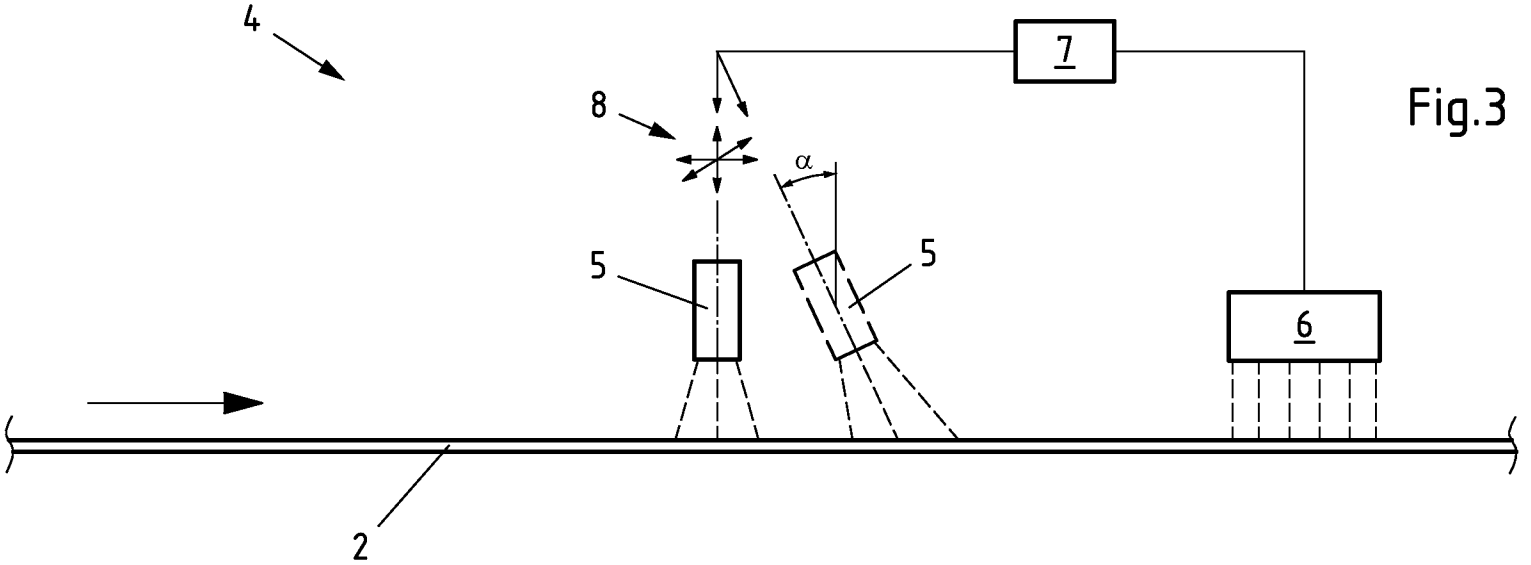
FIG. 3 shows a schematic side view of another embodiment of the device according to the invention.

FIG. 1 is firstly a perspective view of a device for changing the temperature of a metal strip, such as is known from the prior art. The device for changing temperature 1 consists of what is known as a "temperature-control bar", which comprises a plurality of temperature-control means arranged over the width and in part also over the depth of the bar, i.e. in the direction of travel of the strip. As can be seen in FIG. 1, the device known from the prior art can comprise a temperature-control bar both above and below the metal strip 2, which is preferably an aluminium or aluminium alloy strip. As a means for conveying the metal strip relative to the means for changing the temperature of the metal strip, a recoiler 3 is shown in FIG. 1.

Both when cooling the metal strip and when heating the metal strip, the means known from the prior art can be used to change the temperature of the metal strip to only a limited extent, for example by means of a distribution of the temperature-control power changed transversely to the metal strip direction, individual temperature-control of the metal strip can be achieved to reduce flatness defects. In particular during the heat treatment of aluminium strips, it is not possible to precisely control the temperature and introduce a precise temperature profile using said temperature-control means. The limited options for creating a temperature profile in the metal strip lead to stresses remaining in the metal strip as a result of the change in temperature of the metal strip, preferably aluminium alloy strip, which stresses lead to flatness defects after the change in temperature.

FIG. 2 now shows an embodiment of a device 4 according to the invention for changing the temperature of a metal strip, which, according to the invention, comprises a plurality of individual temperature-control means 5 as means for changing the temperature of the metal strip, which temperature-control means each heat or cool the metal strip 2 only in some regions. The position of at least a plurality of temperature-control means can be individually changed relative to the metal strip. This is indicated by the double arrow and by the different arrangement of the individual temperature-control means 5 in FIG. 2. The position of the individual temperature-control means 5 can be adjusted or their position can be changed according to the flatness of the metal strip 2 after the heat treatment or before the heat treatment.

Preferably, for this purpose, the position of the temperature-control means 5 can be individually changed translationally in the longitudinal direction of the metal strip, in the transverse direction of the metal strip and/or at a distance from the metal strip so that a completely individual temperature profile can be introduced into a metal strip continuously changing the temperature.

Preferably, the heating or cooling power of the temperature-control means 5 can be adjusted individually and independently of one another so that an additional parameter is available for reducing flatness defects.

FIG. 3 is now a schematic side view of another embodiment of a device 4 according to the invention for changing the temperature of a metal strip 2. In addition to the temperature-control means 5 known from FIG. 2, which, in contrast with the embodiment from FIG. 2, are shown merely on one side of the metal strip, means for measuring the flatness of the metal strip 6 are shown, which, by means of a control unit 7, control or regulate the position of the individual temperature-control means 5 according to the determined flatness of the metal strip. In the arrangement and direction of travel of the metal strip (arrow) shown in FIG. 3, the control unit 7 regulates the position of the temperature-control means 5 for example continuously according to the flatness values of the metal strip 2 which are determined by the means for measuring the flatness of the metal strip 6. As indicated in FIG. 3, in this case, the control unit 7 can not only utilise the translational degrees of freedom 8 for positioning the temperature-control means 5, but can also carry out a rotation of the temperature-control means 5 by the angle α in order to change the effective regions of the temperature-control means on the metal strip 2 as precisely and continuously as possible. As a result, it is ensured that a very high level of precision in the flatness of the metal strip is achieved both when heating the metal strip, for example when annealing the metal strip, and when cooling the metal strip after an annealing process of this type.

Figure 4:
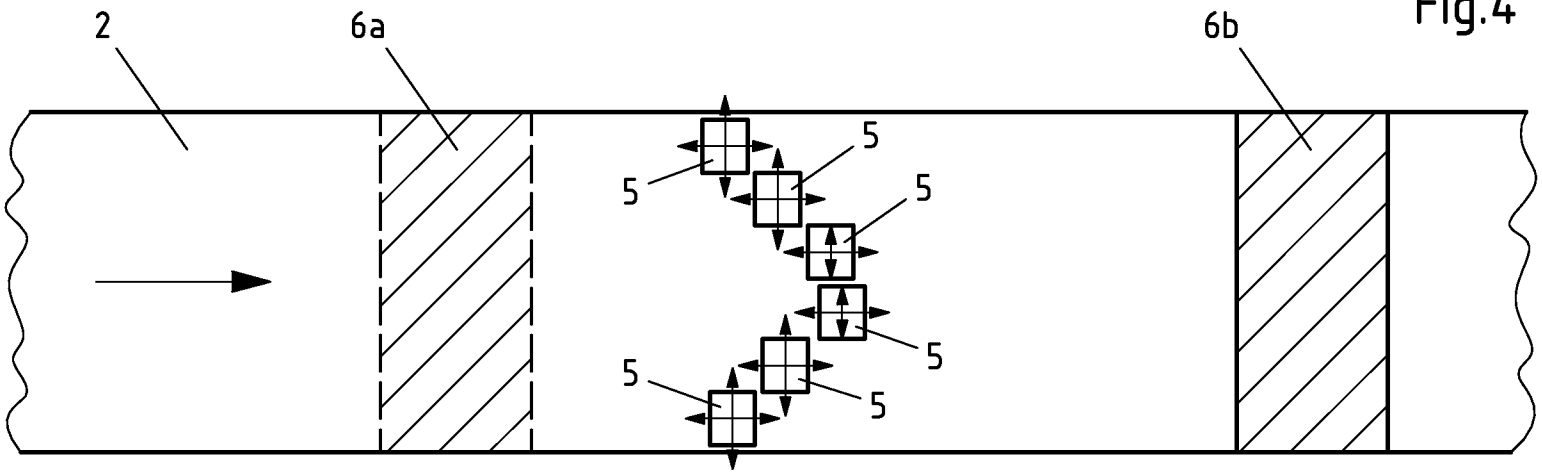
FIG. 4 shows a schematic plan view of another embodiment of a device according to the invention.

A preferred arrangement of the temperature-control means as a result of flatness measurements is shown by FIG. 4 in a plan view of an embodiment of the device 4 according to the invention for changing the temperature of a metal strip. The direction of travel of the metal strip 2 is again indicated by an arrow here. The individual temperature-control means 5 are arranged in an arcuate shape relative to the transverse direction of the metal strip and ensure for example that the metal strip is heated at the edges first, and, at a later point in time only, the centre of the metal strip is heated by the temperature-control means 5. For this purpose, a temperature profile is introduced into the strip, which profile leads to the minimum possible stresses in the metal strip during the transport thereof relative to the means for changing the temperature of the metal strip in the direction of travel of the strip. In FIG. 4, two measurement positions 6*a* and 6*b* are additionally indicated, in which positions the flatness of the metal strip is measured either in advance to control the position of the temperature-control means 5 or afterwards to regulate the flatness of the metal strip. As can be seen in FIG. 4, the change in temperature takes place preferably continuously.

The device according to the invention is therefore suitable in particular for heating metal strips, preferably aluminium alloy strips, without exerting stress, for heat treatment, in particular annealing. Alongside this, the device according to the invention is also suitable for introducing a temperature profile into the metal strip when cooling the metal strip, for example after a heat treatment, which profile leaves behind the minimum possible stresses after cooling the metal strip for example to room temperature.

Preferably, the device according to the invention is used in heat treatment apparatuses to treat metal strips consisting of aluminium alloys. type AA6xxx or composite materials comprising aluminium alloys of the type AA6XXX, since the flatness of these products plays a very important role in the further processing.

Figure 5:
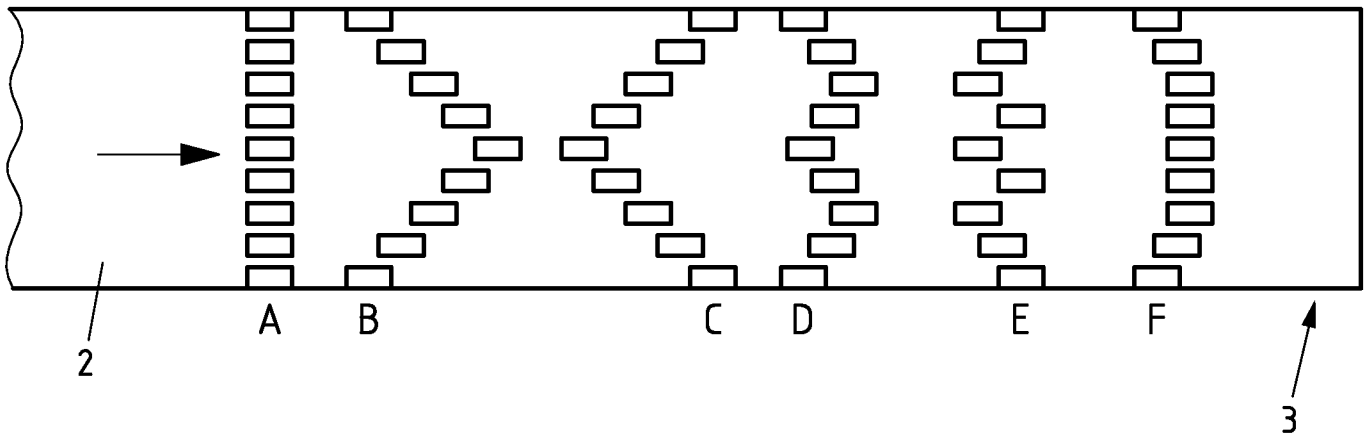
FIG. 5 shows a schematic plan view of different arrangements of temperature-control means for heating an aluminium strip of a device according to the invention.
Figure 6:
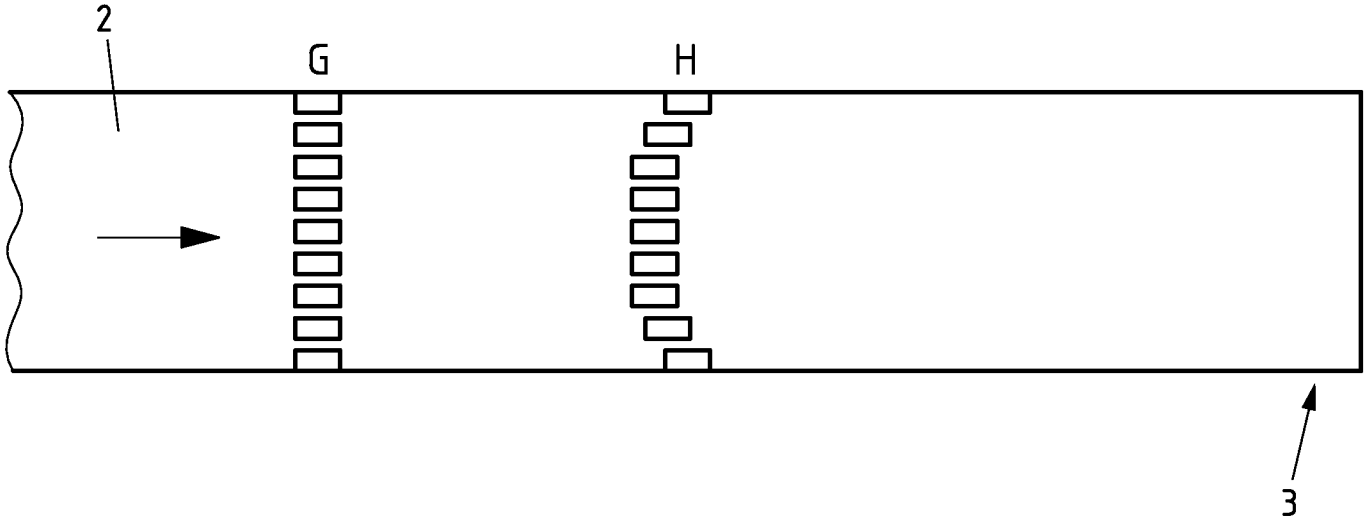
FIG. 6 shows a schematic plan view of different arrangements of temperature-control means for cooling an aluminium strip of a device according to the invention.

FIGS. 5 and 6 are schematic views of different arrangements of the plurality of temperature-control means which, in a contactless manner, heat and, as shown in FIG. 6, cool, the aluminium alloy strip 2 before it is wound onto a coiler 3. In this case, an ideal thermal conduction is assumed. The effect of the different arrangements on the stresses in the aluminium alloy strip 2 has been calculated, and the amplitude of the waviness formation resulting therefrom has been determined.

In the stress calculation for heating, the following initial conditions have been taken into consideration. The initial temperature of the strip is 20° C. before heating. The aluminium alloy strip is heated to 400° C. after a strip region has passed under the respective temperature-control means. In addition, in the case of the heating, subsequent cooling due to heat transfer to the ambient air has been taken into consideration, as well as winding onto a rigid coil, in order to take into consideration boundary conditions which are as close to reality as possible. A strip thickness of 1 mm has been assumed.

In the case of the calculations for cooling, the aluminium alloy has been cooled from a homogeneous temperature of 400° C. to 20° C. after passing through a temperature-control means and, except for heat transfer to the surroundings, identical boundary conditions to those for heating are taken into consideration.

In the simulations, a constant strip tension of 10 MPa has been assumed in the case of a strip width of 1500 mm and a strip speed of approx. 11.3 m/s. In the calculations, the heat transfer of the individual temperature-control means to the strip took place over a length, in the direction of the strip, of 250 mm and a width, which is transverse to the direction of the strip, of 100 mm. By contrast with the schematic views in FIGS. 5 and 6, in each case eleven temperature-control means, above and below the strip, distributed symmetrically over the width of the strip, have been taken into consideration.

The calculations relate to a thermomechanical simulation of stress and deformation states of the aluminium alloy strip by means of the finite element method (FEM). In this case, elastoplastic material behaviour has been conferred to the aluminium alloy strip. The strip 2 has been moved in the direction of the arrow. The calculated amplitudes of the waviness formation, i.e. the difference between the highest and lowest points of the strip, for the different arrangements, are shown in Table 1. To calculate the amplitude of the waviness formation, in each case one section transverse to the direction of travel of the strip has been examined, and the difference between the highest and lowest points of the aluminium alloy strip perpendicular to the plane of the strip has been determined.

TABLE 1

| Experiment | Type of temperature change | Waviness amplitude [mm] |
|---|---|---|
| A | Heating | 22.8 |
| B | Heating | 37.1 |
| C | Heating | 36.5 |
| D | Heating | 21.9 |
| E | Heating | 19.9 |
| F | Heating | 16.1 |
| G | Cooling | 47.6 |
| H | Cooling | 23.3 |

On the basis of the simulations, it is clear that the difference between the highest and lowest points of the strip in relation to the horizontal plane of the strip reacts to the different calculated scenarios in a very sensitive manner. Slight changes in the position of individual temperature-control means, of the type found for example in the comparison between the arrangements D and F, already lead to significant changes in the waviness amplitude. Preferably, for the heating, for example a slight shift of the outer temperature-control means in the opposite direction to the direction of travel of the strip (arrow) can bring about a considerable reduction in the waviness amplitude.

In the simulated cooling of the aluminium alloy strip from a homogeneous temperature of 400° C. to 20° C., an even greater dependence on the waviness amplitude is shown. In this case, the waviness amplitude decreased from 47.6 mm in the case of a linear arrangement F to 23.3 mm as a result of an arrangement G with trailing, outer temperature-control means. When cooling an aluminium alloy strip, the waviness amplitude thus also depends on the precise positioning of the temperature-control means cooling or heating the strip.

The position of the temperature-control means for cooling or heating the metal strip, which position is individually adjusted to the respective stresses of the aluminium alloy strip, can be adjusted particularly well by temperature-control means, the position of which can be individually changed translationally and/or rotationally relative to the metal strip, so that the internal stresses in the strip are minimised.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A device for changing the temperature of a metal strip, comprising means for changing the temperature of the metal strip by heating or cooling, in which, by using means for conveying the metal strip, the metal strip is moved in the strip direction relative to the means for changing the temperature of the metal strip, wherein the means for changing the temperature of the metal strip comprise a plurality of individual temperature-control means which each heat or cool the metal strip only in some regions, and the position of a plurality of the temperature-control means can be individually changed translationally relative to the metal strip, wherein said means for changing the temperature of the metal strip are suitable to change the position of at least one temperature-control means individually translationally in the longitudinal direction of the metal strip, in the transverse direction of the metal strip and/or at a distance from the metal strip, continuously whilst conveying the metal strip relatively to the means for changing the temperature of the metal strip.

2. The device according to claim 1, wherein a plurality of the temperature-control means can be individually changed rotationally relative to the metal strip continuously whilst conveying the metal strip relatively to the means for changing the temperature of the metal strip.

3. The device according to claim 2, wherein at least one temperature-control means is arranged individually rotatable about an axis of rotation so that, by means of rotation, the temperature-control means is variably positionable in its angle to the metal strip surface.

4. The device according to claim 1, wherein the position of at least one temperature-control means can be changed with respect to all the translational and rotational degrees of freedom whilst conveying the metal strip relatively to the means for changing the temperature of the metal strip.

5. The device according to claim 1, wherein the cooling and/or heating power of the individual temperature-control means can be adjusted separately from one another.

6. The device according to claim 1, further comprising means for measuring the flatness of the metal strip and at least one control unit, which control or regulate the geometric position, the geometric orientation of at least one temperature-control means according to the determined flatness of the metal strip.

7. The device of claim 6, wherein the at least one control unit controls or regulates the geometric position, the geometric orientation and/or the cooling or heating power of a plurality of temperature-control means according to the determined flatness of the metal strip.

8. The device according to claim 6, wherein means for measuring the flatness of the metal strip and at least one control unit are provided, which control or regulate the cooling or heating power of at least one temperature-control means according to the determined flatness of the metal strip.

9. The device according to claim 1, wherein the individual temperature-control means transmit heat to the metal strip or extract heat from the metal strip by radiation, conduction, convection and/or induction.

10. The device according to claim 1, wherein the temperature-control means have an arcuate position in relation to the transverse direction of the metal strip, the temperature-control means arranged in the region of the centre of the metal strip being arranged so as to lead or trail in the direction of travel of the metal strip.

11. A method, comprising the step of utilizing a device according to claim 1 in a device for continuously machining metal strips.

12. The method of claim 11, wherein the metal strips are aluminium or aluminium alloy strips.

13. A method for continuously changing the temperature of a metal strip using a device according to claim 1, wherein the temperature of the metal strip is changed in a heat treatment apparatus, in a coating plant or in a rolling mill for metal strips.

14. A method according to claim 13, wherein the position of at least one variably positionable temperature-control means is changed relative to the metal strip in such a way that the stresses in the metal strip are reduced as a result of the change in temperature of the metal strip.

15. A method according to claim 13, wherein a change in temperature of the metal strip takes place by individual temperature-control means which are arranged in an arcuate shape relative to the transverse direction of the metal strip.

16. A method according to claim 13, wherein, by means for measuring flatness, the flatness of the metal strip is detected before and/or after the change in temperature and, according to the measured flatness, using control means, the position of the individual temperature-control means relative to the metal strip is changed.

17. The method of claim 13, wherein the metal strip is an aluminium or aluminium alloy strip.

18. The device of claim 1, wherein the metal strip is made of aluminium or an aluminium alloy.

19. A method for continuously changing the temperature of a metal strip using a device for changing the temperature of a metal strip, comprising means for changing the temperature of the metal strip by heating or cooling, in which, by using means for conveying the metal strip, the metal strip is moved in the strip direction relative to the means for changing the temperature of the metal strip, the means for changing the temperature of the metal strip comprise a plurality of individual temperature-control means which each heat or cool the metal strip only in some regions, and the position of a plurality of the temperature-control means can be individually changed translationally relative to the metal strip, wherein said means for changing the temperature of the metal strip are suitable to change the position of at least one temperature-control means individually translationally in the longitudinal direction of the metal strip, in the transverse direction of the metal strip and/or at a distance from the metal strip, whilst conveying the metal strip relatively to the means for changing the temperature of the metal strip;

wherein the temperature of the metal strip is changed in a heat treatment apparatus, in a coating plant or in a rolling mill for metal strips and the position of the individual temperature-control means relative to the metal strip is changed continuously.

* * * * *